United States Patent [19]

Downing

[11] Patent Number: 4,951,731

[45] Date of Patent: Aug. 28, 1990

[54] PROCESS FOR WASHING A CASTING CORE

[75] Inventor: Robert E. Downing, Toledo, Ohio

[73] Assignee: Farley, Inc., Chicago, Ill.

[21] Appl. No.: 418,586

[22] Filed: Oct. 10, 1989

[51] Int. Cl.[5] ..... B22C 3/00; B22C 9/10

[52] U.S. Cl. ..... 164/14; 164/523; 164/526

[58] Field of Search ..... 164/520, 523, 14, 526; 106/38.22

[56] References Cited

U.S. PATENT DOCUMENTS 3,983,071 9/1976 Jurisch ..... 106/38.2

4,529,028 7/1985 Dybala et al. ..... 164/14

4,867,225 9/1989 Downing ..... 164/369

*Primary Examiner*—Richard K. Seidel

*Assistant Examiner*—Rex E. Pelto

*Attorney, Agent, or Firm*—Hugh Adam Kirk

[57] ABSTRACT

The disclosure concerns a process of producing expendable coated cores for castings comprising mixing sand with a resinous binder, polymerizing the binder, and then washing the resulting bound sand core with an organic solvent to remove unpolymerized residuals from the surface of the core before applying a coating to the core.

7 Claims, No Drawings

PROCESS FOR WASHING A CASTING CORE

BACKGROUND OF THE INVENTION

This application is an improvement over applicant's assignee's U.S. Enno H. Page Patents No. 4,298,051 issued Nov. 3, 1981, No. 4,413,666 issued Nov. 8, 1983, and No. 4,766,943 issued Aug. 30, 1988; Dybala et al U.S. Pat. No. 4,529,028 issued July 16, 1985, and applicant's U.S. Pat. No. 4,867,225 issued Sept. 19, 1989 and applicant's copending application Ser. No. 07/374,649 filed June 30, 1989, all of which deal with die casting cores and their coatings and their respective compositions and methods of producing the same.

Furthermore, sand cores for castings in which the sand is bound together by a polymerized resin are known according to Lirones U.S. Pat. No. 3,321,005 issued May 23, 1967, Robins U.S. Pat. No. 3,639,654 issued Feb. 1, 1972, and Horton U.S. Pat. No. 3,688,832 issued Sept. 5, 1972, the latter of which even mentions rinsing a core with solvents.

However, none of the above references discloses all of the specific steps and specific compositions invented and disclosed herein.

SUMMARY OF THE INVENTION

The process of this invention comprises producing a coated sand core to form undercut regions in a casting. The core is produced by mixing less than about 2% by weight of the sand, of a resinous binder and a catalyst with sand, and placing the mixture in a mold and polymerizing the binder to form a solid core. The catalyst or hardening agent for polymerizing the resinous binder is preferably an acid catalyst so that the polymerization can take place at a temperature below about 450° F. Since polymerization is rarely complete, when a liquid suspension of a coating for the core is applied, unpolymerized residuals in the core often react with the coating so that the coating does not completely cover the surface of the core. This results in an unacceptable surface on the casting adjacent the core.

In order to overcome this undesirable result, applicant has discovered that if the polymerized core is dipped or washed, preferably more than once, in an organic solvent, such as a lower aliphatic alcohol, the unpolymerized residuals near the surface of the core are removed. Then after the core has been dried, the coating for the core generally forms a continuous and uniform surface over the core, as well as being held to the core by impregnation of the sand grains adjacent the surface of the core which now have been washed clean of unpolymerized residuals.

After the coating, usually containing a refractory material in suspension, has been applied to the core and its carrier liquid has been evaporated therefrom, the core is ready for use in a casting die.

OBJECTS AND ADVANTAGES

It is an object of this invention to produce a simple, efficient, effective and economic process for producing coated sand cores for castings that produce a smooth surface on the castings.

Another object is to produce such coated expendable cores that may be used in high pressure die casting machines and that have good shake-out properties, good wash-out resistance to hot metal, are free from surface penetration by hot metal, have a good shelf life, and a high core strength to withstand pressures in excess of 1000 psi and still form smooth undercut regions in a die casting.

Still another object is to produce such an expendable core in which its coating both completely coat as well as adhere to the sand cores upon which they are applied, and do not react with any residuals of the binder in the core itself.

DETAILED DESCRIPTION OF PREFERRED EMBODIMENTS

The expendable cores of this invention have a base comprising a foundry sand, preferably a high silica clean sand. The grains of this sand are bound together by an organic resinous material which is deteriorated by the heat of the hot metal in the casting die after the metal has solidified. Such resins comprise thermosetting resins such as phenol, aldehyde, furan, furfural, etc. resins, which are mixed with a catalyst (for polymerizing the resin) and the sand, and then placed into a mold to form the core of the shape desired. The catalyst used for these resins is primarily an acid catalyst such as a sulfonic acid or a cupric salt of sulfonic acid in a solvent solution. In this mold, the mixture is heated to a temperature less than about 450° F. and preferably between about 200° and 400° F., and more preferably about 350° F., to polymerize the resin and bind the sand grains therein together to form a solid core.

After the resinous binder has been substantially all polymerized to form a solid core of the proper desired shape in the mold, the core is removed from the mold and cooled to about room temperature. Now before coating the core, the core is washed or dipped into a lower aliphatic alcohol solvent, that is an alcohol of one to four carbon atoms, to wash out any of the unpolymerized residuals or unreacted organic chemicals that may remain between the sand grains near the surface of the core. In order to have an effective removal of these unpolymerized residuals, it is desirable to dip and drain the core several times, say about at least twice and preferably three times, permitting sufficient time after dipping for the alcohol to drain well from the core. For example, each time the core is dipped in alcohol, it is held in the alcohol for about 30 seconds and then suspended above the alcohol in air for about 60 seconds until substantially all the alcohol has dripped from the core. After the surface of core has been so washed, it is dried, such as in a dryer or oven for about 30 minutes at about 90° C., to remove all of the alcohol that may be retained therein. The dried core is then cooled in air to room temperature.

The core now is ready to have a coating placed thereon, such as those coatings disclosed in the above mentioned patents and copending application assigned to assignee of this application. For example, in the Dybala et al U.S. Pat. No. 4,529,028 and in the copending Downing application above mentioned, there are applied two successive different coating suspended in different liquid carriers. At least one coating contains a refractory material, as well as a binder. The washing-out of the residuals from the surface grains of the core permit the liquid carrier for the coating to impregnate the surface of the core and accordingly become better anchored thereto, as well as being able to produce a smooth, continuous and uniform coating on the core that does not react chemically with any organics in the core.

Before the core is placed in a die, however, it is completely dried, such as in an oven, to drive out or evaporate all the liquid carriers that may have remained on the core after its coating.

Although the expendable coated cores of this invention for producing undercut regions in a casting may be used in high pressure die casting dies, these cores also may be used in low pressure and gravity castings.

While there is described above the principles of this invention in connection with specific process, it is to be clearly understood that the description is made only by way of example and not as a limitation of the scope of the invention.

What is claimed is:

1. A method for producing an expendable coated sand core to form undercut regions in a casting; the steps comprising:

(1) mixing said sand with less than about 2% by weight of said sand with a resinous binder and a catalyst, (2) placing the mixture in a mold for shaping the core, (3) heating the mold to a temperature below about 450° F. until most of said resin in polymerized to produce a solid core, (4) cooling said core to about room temperature, (5) dipping the cooled core in a lower aliphatic alcohol to wash out unpolymerized residuals near the surface of said core, (6) drying said core to remove said alcohol, (7) coating said core with a liquid suspension of at least one refractory material, and (8) drying said core to remove said liquid from said suspension.

2. A method according to claim 1 wherein said core is for use in the dies of high pressure die casting machines.

3. A process according to claim 1 wherein said heating of said mixture in said mold is between about 200° and 400° F.

4. A method according to claim 1 wherein said dipping is repeated at least twice.

5. A method according to claim 1 wherein said resinous binder comprises a furan resin.

6. A method according to claim 1 wherein said catalyst comprises a sulfonic acid compound.

7. A method according to claim 1 wherein said lower aliphatic alcohol has from one to four carbon atoms.

* * * * *